US012135165B2

(12) United States Patent
Haik-Beraud et al.

(10) Patent No.: US 12,135,165 B2
(45) Date of Patent: Nov. 5, 2024

(54) METHOD FOR LIQUEFYING NATURAL GAS WITH IMPROVED CIRCULATION OF A MIXED REFRIGERANT STREAM

(71) Applicant: L'Air Liquide, Société Anonyme pour l'Etude et l'Exploitation des Procédés Georges Claude, Paris (FR)

(72) Inventors: Natacha Haik-Beraud, Champigny-sur-Marne (FR); Jean-Marc Peyron, Creteil (FR); Sophie Lazzarini, Saint Mande (FR); Thomas Morel, Champs-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 272 days.

(21) Appl. No.: 17/632,136

(22) PCT Filed: Jul. 21, 2020

(86) PCT No.: PCT/FR2020/051319
§ 371 (c)(1),
(2) Date: Feb. 1, 2022

(87) PCT Pub. No.: WO2021/019153
PCT Pub. Date: Feb. 4, 2021

(65) Prior Publication Data

US 2022/0275997 A1 Sep. 1, 2022

(30) Foreign Application Priority Data

Aug. 1, 2019 (FR) ..... 1908807

(51) Int. Cl.
*F25J 1/00* (2006.01)
*F25J 1/02* (2006.01)

(52) U.S. Cl.
CPC ..... *F25J 1/0022* (2013.01); *F25J 1/0057* (2013.01); *F25J 1/0262* (2013.01)

(58) Field of Classification Search
CPC .... F25J 1/0022; F25J 5/00; F25J 5/002; F25J 2205/24; F28F 3/02; F28F 3/08;
(Continued)

(56) References Cited

U.S. PATENT DOCUMENTS 3,992,168 A 11/1976 Toyama et al.
4,181,174 A 1/1980 Grenier
(Continued)

FOREIGN PATENT DOCUMENTS

CN 108106469 A * 6/2018 ..... F28D 9/0006
EP 1 088 578 4/2001
(Continued)

OTHER PUBLICATIONS

Fischer, B., A new process to reduce LNG cost, ICHE Spring Meeting, Natural Gas Utilization Conference, X, US, Mar. 10, 2002, 191-202.
(Continued)

*Primary Examiner* — Brian M King
(74) *Attorney, Agent, or Firm* — Elwood L. Haynes

(57) ABSTRACT

A method for liquefying a hydrocarbon stream using a heat exchanger having a plurality of plates parallel to each other and to a longitudinal direction that is substantially vertical, the exchanger having a length measured in the longitudinal direction, the plates being stacked with spacing so as to define between them at least one first series of passages for
(Continued)

the flow of at least part of a two-phase cooling stream vaporizing by exchanging heat with at least the hydrocarbon stream.

8 Claims, 5 Drawing Sheets

(58) Field of Classification Search
CPC .. F28F 3/12; F28F 3/14; F28D 1/0308; F28D 1/0366; F28D 9/005; F28D 9/0006; F28D 9/0037; F28D 9/0062; F28D 9/0081
See application file for complete search history.

(56) References Cited

U.S. PATENT DOCUMENTS

| | | | | |
|---|---|---|---|---|
| 4,330,308 | A | 5/1982 | Grenier et al. | |
| 4,646,822 | A | 3/1987 | Voggenreiter et al. | |
| 5,199,266 | A | 4/1993 | Johansen | |
| 2007/0227185 | A1* | 10/2007 | Stone | F25J 1/0042 62/611 |
| 2012/0067079 | A1 | 3/2012 | Sethna et al. | |
| 2013/0255924 | A1* | 10/2013 | Dietrich | F28F 3/08 29/890.039 |
| 2015/0260451 | A1 | 9/2015 | Haberberge et al. | |
| 2018/0299210 | A1* | 10/2018 | Ronacher | F28F 3/027 |
| 2018/0356150 | A1 | 12/2018 | Chambron | |
| 2021/0164734 | A1 | 6/2021 | Haik-Beraud et al. | |

FOREIGN PATENT DOCUMENTS

| | | | |
|---|---|---|---|
| EP | 3 015 807 | | 5/2016 |
| EP | 3339785 | A1 * | 6/2018 |
| FR | 2 563 620 | | 10/1985 |
| FR | 1 857 133 | | 2/2020 |
| WO | WO 2014 087225 | | 6/2014 |
| WO | WO 2017 081374 | | 5/2017 |
| WO | WO 2017 134353 | | 8/2017 |
| WO | WO 2018 172644 | | 9/2018 |

OTHER PUBLICATIONS

Onaka, M. et al., Use of plate fin heat exchangers for main cryogenic exchanger units, LNG Journal, Nelton Publications, Gravesend, GB, Jan. 1, 1997, 17-19.

Paradowski, H. et al., Experimental study of plate heat exchangers condensing and vaporizing liquefied hydrocarbon gases, GPA Technical Meeting, Feb. 1, 2001, 1-14.

Stone, J. B. et al., LNG process selection considerations for future developments, International Conference and Exhibition of Liquefied Natural Gas (LNG), Apr. 18, 2010, Oran, Algeria, vol. 16, Poster PO1-13, 1-9.

International Search Report for corresponding PCT/FR2020/051319, Oct. 30, 2020.

* cited by examiner

METHOD FOR LIQUEFYING NATURAL GAS WITH IMPROVED CIRCULATION OF A MIXED REFRIGERANT STREAM

CROSS REFERENCE TO RELATED APPLICATIONS

This application is a 371 of International Application No. PCT/FR2020/051319, filed Jul. 21, 2020, which claims priority to French Patent Application No. 1908807, filed Aug. 1, 2019, the entire contents of which are incorporated herein by reference.

BACKGROUND

The present invention relates to a method for liquefying a hydrocarbon stream, such as natural gas, said method using a mixed two-phase cooling stream that vaporizes against the hydrocarbon stream to be liquefied in a heat exchanger of the plate and fin type.

It is desirable for natural gas to be liquefied for a number of reasons. By way of an example, natural gas can be stored and transported over long distances more easily in the liquid state than in the gaseous state, since it occupies a smaller volume for a given mass and does not need to be stored at high pressure.

Several methods exist for liquefying a natural gas stream in order to obtain liquefied natural gas (LNG). Typically, a cooling stream, generally a mixture of several constituent elements, such as a mixture containing hydrocarbons, is compressed by a compressor, then introduced into an exchanger, where it is completely liquefied and sub-cooled to the coldest temperature of the method, typically that of the liquefied natural gas stream. At the coldest outlet of the exchanger, the cooling stream is expanded, forming a liquid phase and a gaseous phase. These two phases are remixed and reintroduced into the exchanger. The cooling stream introduced into the exchanger in the two-phase state is vaporized therein against the hydrocarbon stream that liquefies. Documents WO-A-2017/081374 and US 2007-A-0227185 describe such known methods.

The use of aluminum brazed plate and fin heat exchangers allows highly compact devices to be obtained that provide a large exchange surface area, which improves the energy performance capabilities of the liquefaction method described above.

These exchangers comprise a stack of plates that extend in two dimensions, lengthwise and widthwise, thus forming a stack of several series of passages, with some being intended for circulating a heat-transfer fluid, in this case the hydrocarbon stream to be liquefied, and others being intended for circulating a refrigerant, in this case the two-phase cooling stream to be vaporized.

Heat exchange structures, such as heat exchange waves, are generally disposed in the passages of the exchanger. These structures comprise fins that extend between the plates of the exchanger and allow the heat exchange surface area of the exchanger to be increased. Conventionally, these heat exchange structures have uniform properties and structures along the passages of the exchanger.

However, certain problems continue to arise with the known liquefaction methods, in particular due to the two-phase composition of the cooling stream reintroduced into the exchanger, and in particular when its vaporization occurs in an upward vertical flow.

Indeed, the two-phase cooling stream is introduced at the cold end of the exchanger, i.e. the end where a fluid is introduced with the lowest temperature of the temperatures of the exchanger, located at the lower end of the exchanger. The partial vaporization rate (or "flash") is very low. As the cooling stream flows through the passages of the exchanger toward the upper end forming the hot end, the rate of partial vaporization, and therefore the amount of gas contained in the cooling stream, increases.

However, gas needs to be present in order to entrain the liquid phase of the cooling stream in order to compensate for the effect of gravity. As the amount of gas is lower at the cold end of the exchanger, entraining the liquid with the gas is more difficult. Therefore, the flow rate of the cooling stream is lower at the cold end and then increases toward the upper end of the exchanger, as the cooling stream is vaporized. This results in an inhomogeneous distribution of the cooling stream along the length of the exchanger.

In order to overcome the shortage of gas at the cold end, a known solution involves reducing the cross-section of the exchanger. The cross-section available for circulating the cooling stream is reduced, which allows the volume flow and the flow rate of the cooling stream to be increased at the cold end.

However, this solution results in a major disadvantage. Indeed, the cross-section of the exchanger is designed by considering the cold end, where the flow rate of the cooling stream is the lowest. However, this speed continues to increase along the flow path of the cooling stream, as the amount of gas increases, which leads to an excessively high level of pressure drops at the hot end, due to the reduced cross-section of the exchanger. This results in a degradation of the energy performance capabilities of the method.

SUMMARY

The aim of the present invention is to overcome all or some of the aforementioned problems, in particular by proposing a method for liquefying a hydrocarbon stream against a two-phase cooling stream, said method using a heat exchanger ensuring more homogeneous distribution of said cooling stream in the length of the exchanger.

The solution according to the invention then involves a method for liquefying a hydrocarbon stream, such as natural gas, using a heat exchanger comprising a plurality of plates parallel to each other and to a longitudinal direction that is substantially vertical, said exchanger having a length measured in the longitudinal direction, the plates being stacked with spacing so as to define between them at least one first series of passages for the flow of at least part of a two-phase cooling stream vaporizing by exchanging heat with at least the hydrocarbon stream, said method comprising the following steps:

a) introducing the hydrocarbon stream into the heat exchanger;
b) introducing a cooling stream into the heat exchanger via at least one first inlet up to a first outlet, said first inlets and outlets being arranged so that the cooling stream flows through the exchanger in a downward direction opposite to the longitudinal direction;
c) discharging the cooling stream via the first outlet of the exchanger;
d) expanding the cooling stream originating from step c) so as to produce a two-phase cooling stream;
e) reintroducing at least part of the cooling stream into the heat exchanger via at least one second inlet up to a second outlet, said second inlets and outlets being arranged so that said at least part of the two-phase cooling stream flows through the passages of the first series in an upward direction oriented in the longitudinal direction;

f) at least partially vaporizing said at least part of the two-phase cooling stream in the passages of the first series by exchanging heat with at least the hydrocarbon stream so as to obtain an at least partially liquefied hydrocarbon stream at the outlet of the exchanger, characterized in that at least one passage of the first series comprises a heat exchange structure comprising a plurality of series of fluid guiding walls, said series of walls following one another in the longitudinal direction and having leading edges that extend orthogonally to the longitudinal direction so as to fully or partly face the two-phase cooling stream, said heat exchange structure having a cross-sectional area of leading edges, measured orthogonally to the longitudinal direction and expressed per meter of exchanger length, that decreases in the longitudinal direction.

As appropriate, the invention can comprise one or more of the following feature(s):

in step e), the liquid/gas volume ratio of said at least part of the two-phase cooling stream reintroduced into the heat exchanger ranges between 10 and 100%, preferably between 10 and 60%, said at least part of the two-phase cooling stream flowing in the passages of the first series having a liquid/gas volume ratio that decreases in the longitudinal direction;

the heat exchange structure is divided, in the longitudinal direction, into a plurality of portions each having a cross-sectional area of leading edges with a predetermined value, one portion arranged downstream of another portion in the longitudinal direction, preferably consecutively, having a cross-sectional area of leading edges that is smaller compared to the cross-sectional area of leading edges of the other portion by a factor of at least 1.3, preferably a factor ranging between 1.5 and 5;

the two-phase cooling stream flowing through the portion arranged upstream of the other portion has a liquid/gas volume ratio at least 2% higher, preferably 2 to 20% higher, than the liquid/gas volume ratio of the two-phase cooling stream flowing through the other portion;

the heat exchange structure is divided, in the longitudinal direction, into a plurality of portions each having a cross-sectional area of leading edges with a predetermined value, with said predetermined surface area values decreasing in the longitudinal direction;

said portions form separate physical entities brazed together in said passage and/or at least one of said portions is formed by a plurality of separate sub-portions brazed together in said passage;

said series of fluid guiding walls each form a corrugation comprising a plurality of fins following each other in a lateral direction, which is orthogonal to the longitudinal direction and parallel to the plates, with wave peaks and wave troughs alternately connecting said fins;

said corrugations have increasing pitches in the longitudinal direction, said pitches being defined as the distances between two successive fins of the same corrugation measured in the lateral direction;

the fluid guiding walls have decreasing thicknesses in the longitudinal direction;

said series of fluid guiding walls form corrugations having a corrugation direction oriented in the lateral direction, at least part of said corrugations having a predetermined offset in the lateral direction with respect to another adjacent corrugation, said offset corrugations having lengths, called serration lengths, measured in the longitudinal direction, that increase in the longitudinal direction;

the heat exchange structure is divided, in the longitudinal direction, into a plurality of portions each comprising a plurality of series of fluid guiding walls arranged consecutively in the longitudinal direction (z), with each series forming a corrugation, each portion (S1, S2) having corrugations having a predetermined offset in the lateral direction (y) relative to another adjacent corrugation, each portion (S1, S2) comprising corrugations with a length, called serration length (L1, L2), measured in the longitudinal direction (z), the portions (S1, S2) being arranged in ascending order of their respective serration length (L1, L2) in the longitudinal direction (z);

said portions (S1, S2) have at least one identical parameter of their corrugations selected from the predetermined offset, the thickness, the pitch.

in step a), the hydrocarbon stream is introduced into the heat exchanger in the gaseous or partially liquefied state at a temperature ranging between −80 and −35° C.;

in step a), the hydrocarbon stream is introduced into the heat exchanger in the completely liquefied state at a temperature ranging between −130 and −100° C.;

in step e), said at least part of the two-phase cooling stream is introduced into the heat exchanger at a first temperature ranging between −120 and −160° C. and exits the heat exchanger at a second temperature higher than the first temperature, preferably the second temperature ranges between −35 and −130° C.;

in step e), the two-phase cooling stream introduced into the heat exchanger has a liquid/gas volume ratio ranging between 10 and 100%, preferably ranging between 10 and 60%.

prior to step a), at least one additional refrigeration cycle is implemented comprising the following steps:

i) introducing a supply stream comprising a mixture of hydrocarbons, such as natural gas, into an additional heat exchanger comprising a set of other plates parallel to each other and to the longitudinal direction and stacked with spacing so as to define between them at least one set of additional refrigerant passages;

ii) introducing an additional cooling stream into the additional heat exchanger;

iii) extracting, from the heat exchanger, at least two partial cooling streams originating from the additional cooling stream and expanding said partial cooling streams to different pressure levels in order to produce at least two two-phase refrigerants;

iv) reintroducing at least part of each refrigerant into respective additional refrigerant passages of the heat exchanger and at least partially vaporizing said at least part of each refrigerant by exchanging heat with at least the supply stream so as to obtain a pre-cooled hydrocarbon stream at the outlet of the additional heat exchanger;

v) introducing the pre-cooled hydrocarbon stream into the heat exchanger.

Preferably, the refrigerants flow upward in the longitudinal direction in the respective additional refrigerant passages of the heat exchanger.

More preferably, at least one additional refrigerant passage comprises at least one additional heat exchange structure comprising a plurality of additional series of fluid guiding walls, said series following each other in the longitudinal direction and having additional leading edges extending orthogonally to the longitudinal direction so as to fully or partly face the two-phase refrigerants, said additional heat exchange structure having a cross-sectional area of leading edges that decreases in the longitudinal direction.

The expression "natural gas" relates to any composition containing hydrocarbons, at least including methane. This comprises a "crude" composition (prior to any treatment or scrubbing) and also any composition which has been partially, substantially or completely treated for the reduction and/or removal of one or more compounds, including, but without being limited thereto, sulfur, carbon dioxide, water, mercury and certain heavy and aromatic hydrocarbons.

BRIEF DESCRIPTION OF THE DRAWINGS

The present invention will now be better understood by virtue of the following description, which is provided solely by way of a non-limiting example and with reference to the accompanying figures, in which.

DETAILED DESCRIPTION OF PREFERRED EMBODIMENTS

Figure 1:
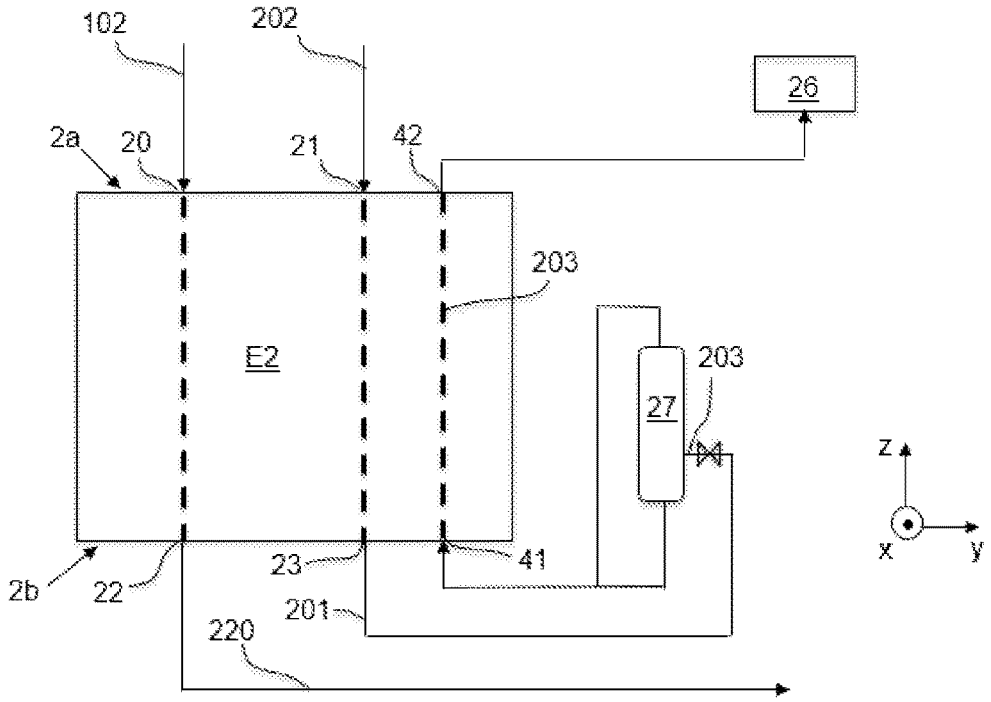
FIG. 1 schematically shows a method for liquefying a hydrocarbon stream according to one embodiment of the invention.

FIG. 1 schematically shows a method for liquefying a hydrocarbon stream 102 that can be natural gas, optionally pre-treated, for example, having undergone the separation of at least one of the following constituent elements: water, carbon dioxide, sulfur compounds, methanol, before being introduced into the heat exchanger E2.

Preferably, the natural gas stream comprises, as a mole fraction, at least 60% methane, preferably at least 80%.

The natural gas 102 can be fractionated, i.e. part of the C2+ hydrocarbons containing at least two carbon atoms is separated from the natural gas using a device that is known to a person skilled in the art. The collected hydrocarbons C2+ are sent into fractionating columns comprising a de-ethanizer. The light fraction collected at the top of the de-ethanizer can be mixed with natural gas 102. The liquid fraction collected at the bottom of the de-ethanizer is sent to a de-propanizer.

The hydrocarbon stream 102 and the cooling stream 202 enter the exchanger E2, respectively via a third inlet 20 and a first inlet 21, in order to circulate therein in dedicated passages of the exchanger in directions parallel to the longitudinal direction z, which is substantially vertical during operation. These streams exit via a third outlet 22 and a first outlet 23.

Advantageously, the first inlet 21 for the cooling stream 202 and the third inlet 20 for the hydrocarbon stream are arranged so that the cooling stream 202, and optionally the hydrocarbon steam 102, flow co-currently in the downward direction, toward a second end 2*b* of the exchanger, which is located at a level below the level of a first end 1*a* of said exchanger. Preferably, the first end 2*a* corresponds to the hot end of the exchanger E2, i.e. the point of entry of the exchanger where a fluid is introduced at the highest temperature of the exchanger temperatures, in this case the third inlet 20.

Preferably, the hydrocarbon stream 102 is introduced into the heat exchanger E2 in the completely gaseous or partially liquefied state at a temperature ranging between −80 and −35° C.

According to another possibility, the hydrocarbon stream 102 is introduced into the exchanger E2 in the completely liquefied state at a temperature ranging between −130 and −100° C.

The cooling stream 201 exiting the exchanger E2 is expanded by an expansion component T3, such as a turbine, a valve or a combination of a turbine and a valve, so as to form a two-phase cooling stream 203 comprising a liquid phase and a gaseous phase. At least part of the two-phase cooling stream 203 originating from the expansion is reintroduced into the exchanger E2 via at least one second inlet 41 located in the region of the second end 2*b* and supplying a first series of passages 10 of the exchanger.

Preferably, the second end 2*b* corresponds to the cold end, which corresponds to a point of entry of the exchanger where a fluid is introduced at the lowest temperature of the exchanger temperatures, in this case the second inlet 41.

It should be noted that, within the scope of the invention, the reintroduction of said at least part of the two-phase cooling stream 203 can be achieved in several ways.

The two phases of the two-phase stream 203 can be separated beforehand in a separator component 27 before being recombined outside the exchanger and reintroduced into the exchanger E2 in the liquid/gas mixture state via the same inlet 41, as shown in FIG. 1. The separator component can be any device suitable for separating a two-phase fluid into a gas stream, on the one hand, and a liquid stream, on the other hand. The two-phase stream 203 is thus entirely or almost entirely reintroduced.

According to an alternative embodiment (not shown), the liquid and gaseous phases can be separately introduced into the exchanger via separate inlets, then mixed together within the exchanger, by means of a mixing device, as described in FR-A-2563620 or WO-A-2018172644, for example. These devices are typically machined parts comprising a particular arrangement of separate channels for a liquid phase and a gaseous phase and of orifices placing these passages in fluid communication in order to dispense a liquid/gas mixture. The two-phase stream 203 is thus entirely or almost entirely reintroduced.

According to another alternative embodiment (not shown), only the liquid phase separated from the two-phase stream 203 is reintroduced via the second inlet 41. This liquid phase forms said part of the two-phase cooling stream 203. The gaseous phase is preferably diverted from the exchanger E2, i.e. it is not introduced therein. It should be noted that the two-phase fluid optionally can be directly reintroduced in the liquid/gas mixture state following expansion.

Preferably, said at least part of the two-phase cooling stream 203 is introduced into the heat exchanger E2 at a first temperature T1 ranging between −120 and −160° C. and exits the heat exchanger E2 at a second temperature T2 higher than the first temperature T1, preferably with T2 ranging between −35 and −130° C.

Said at least part of the two-phase cooling stream 203 flows through the passages 10 in an upward direction and is vaporized by counter-currently refrigerating the natural gas 102 and the cooling stream 202.

The vaporized cooling stream exits the exchanger E2 via a second outlet 42 in order to be compressed by a compressor and then cooled in the indirect heat exchanger by exchanging heat with an external cooling fluid, for example, water or air (in 26 in FIG. 1). The pressure of the cooling stream at the outlet of the compressor can range between 2 MPa and 8 MPa. The temperature of the cooling stream at the outlet of the indirect heat exchanger can range between 10° C. and 45° C.

In the method described in FIG. 1, the cooling stream is not split into separate fractions, but, in order to optimize the approach in the exchanger E2, the cooling stream also can be separated into two or three fractions, with each fraction being expanded to a different pressure level and then sent to different stages of the compressor K2.

Preferably, the cooling stream 202 contains hydrocarbons with a number of carbon atoms of at most 5, preferably at most three, more preferably at most two.

Preferably, the cooling stream 202 is formed, for example, by a mixture of hydrocarbons and nitrogen, such as a mixture of methane, ethane and nitrogen, but can also contain propane, butane, pentane and/or ethylene.

The mole fraction proportions (%) of the components of the cooling stream can be:

Nitrogen: 0% to 10%;

Methane: 30% to 70%;

Ethane: 30% to 70%;

Propane: 0% to 10%;

The natural gas exits the exchanger E2 in the at least partially liquefied state 220 at a temperature that preferably is at least 10° C. higher than the bubble point of the liquefied natural gas produced at atmospheric pressure (the bubble point refers to the temperature at which the first vapor bubbles form in a liquid natural gas at a given pressure) and at a pressure identical to the natural gas inlet pressure, to the nearest pressure drops. For example, the natural gas exits the exchanger E2 at a temperature ranging between −105° C. and −145° C. and at a pressure ranging between 4 MPa and 7 MPa. Under these temperature and pressure conditions, the natural gas does not remain entirely liquid after expansion to atmospheric pressure.

Figure 2:
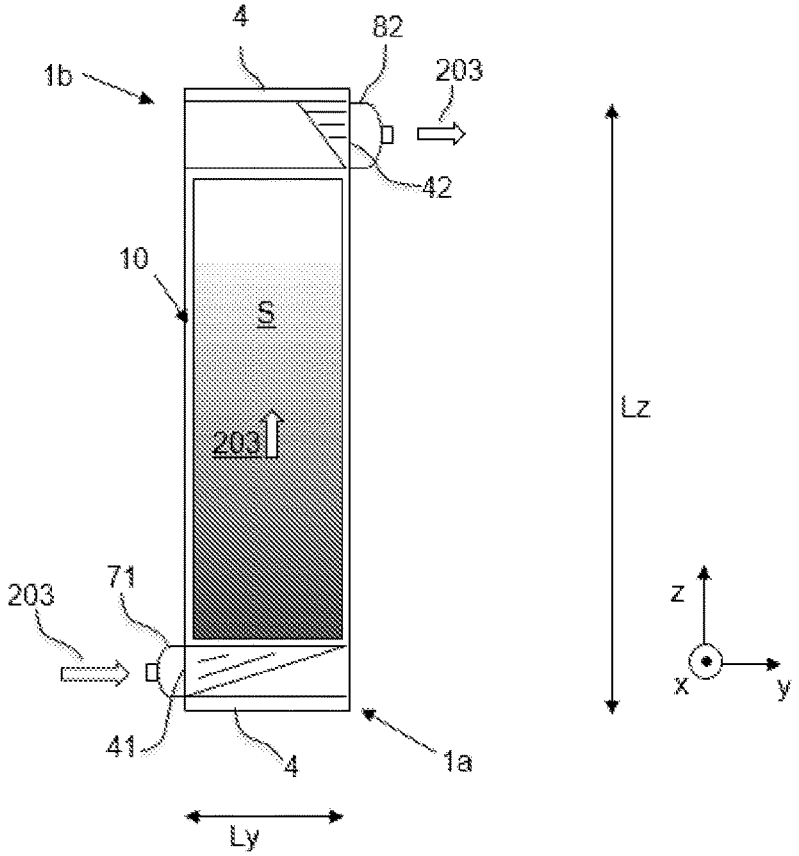
FIG. 2 is a schematic section view, in a plane parallel to the plates of the exchanger, of an exchanger passage configured for the flow of the two-phase cooling stream according to one embodiment of the invention.

FIG. 2 shows a passage 10 of an exchanger E2 according to the invention configured to vaporize the two-phase cooling stream. The exchanger E2 comprises a plurality of plates 2 (not shown) that extend in two dimensions, lengthwise Lz and widthwise Ly, of the exchanger, respectively in a longitudinal direction z and a lateral direction y orthogonal to z and parallel to the plates 2. The plates 2 are disposed in parallel one above the other with spacing in a stacking direction x, thus forming a plurality of passages for the fluids of the method that are intended for indirect exchange of heat via the plates. A passage 10 is formed between two adjacent plates. Preferably, each passage of the exchanger has a parallelepiped and flat shape. The gap between two successive plates is small compared to the length and the width of each successive plate.

The hydrocarbon stream 102 circulates in a second series of passages (not shown) that are fully or partly arranged alternating and/or adjacent to all or part of the passages 10 of the first series. The flow of fluids in the passages generally occurs parallel to the longitudinal direction z, which is vertical during the operation of the exchanger.

The sealing of the passages 10 along the edges of the plates is generally provided by lateral and longitudinal sealing strips 4 attached to the plates. The lateral sealing strips 4 do not completely seal the passages 10, but leave inlet 41 and outlet 42 openings. The inlets and outlets 41, 42 of the overlaid passages 10 are joined by manifolds 71, 82 used for introducing and discharging the cooling stream 203.

Conventionally, the passages 10 comprise one or more heat exchange structures S disposed between the plates 2. The purpose of these structures is to increase the heat exchange surface area of the exchanger. Specifically, the heat exchange structures are in contact with the fluids circulating in the passages and transfer heat flows by conduction as far as the adjacent plates.

The heat exchange structures also act as spacers between the plates 2, in particular during the assembly of the exchanger by brazing, and to avoid any deformation of the plates when pressurized fluids are being used. They also provide guidance for the flows of fluid in the passages of the exchanger.

For the sake of convenience, it is normal for heat exchange structures of the same type to be arranged along an exchanger passage. For example, when these structures are formed by waves, these have corrugations of the same type, in particular the same corrugation span and therefore the same density of fins, the same thickness, etc.

However, the inventors of the present invention have demonstrated that, with such a configuration, disparities in pressure drops and flow rates appear as the cooling stream flowed along the passages 10, in particular due to the progressive vaporization of said cooling stream.

In order to overcome these problems, the invention proposes arranging, in at least one passage 10 of the first series, a heat exchange structure allowing the pressure drops to be balanced along the length of said passage.

More specifically, at least one passage 10 comprises a heat exchange structure S, the cross-sectional area of leading edges of which decreases in the longitudinal direction z, i.e. toward the first end of the exchanger.

FIG. 4 to FIG. 7 show examples of heat exchange structures that can be arranged in the passage 10 and illustrate the leading edges of these structures.

Figure 4:
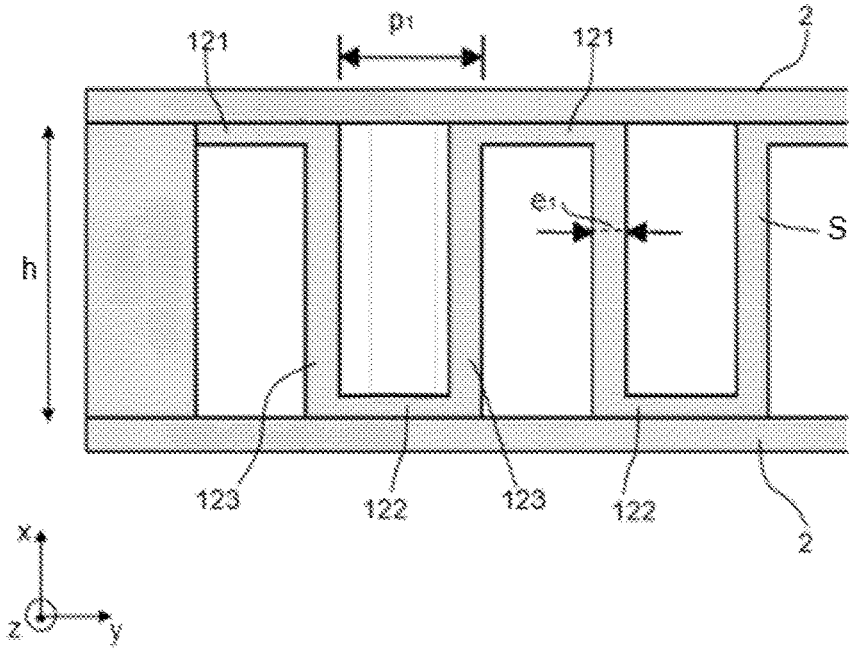
FIG. 4 shows a portion of a heat exchange structure of an exchanger according to one embodiment of the invention.
Figure 5:
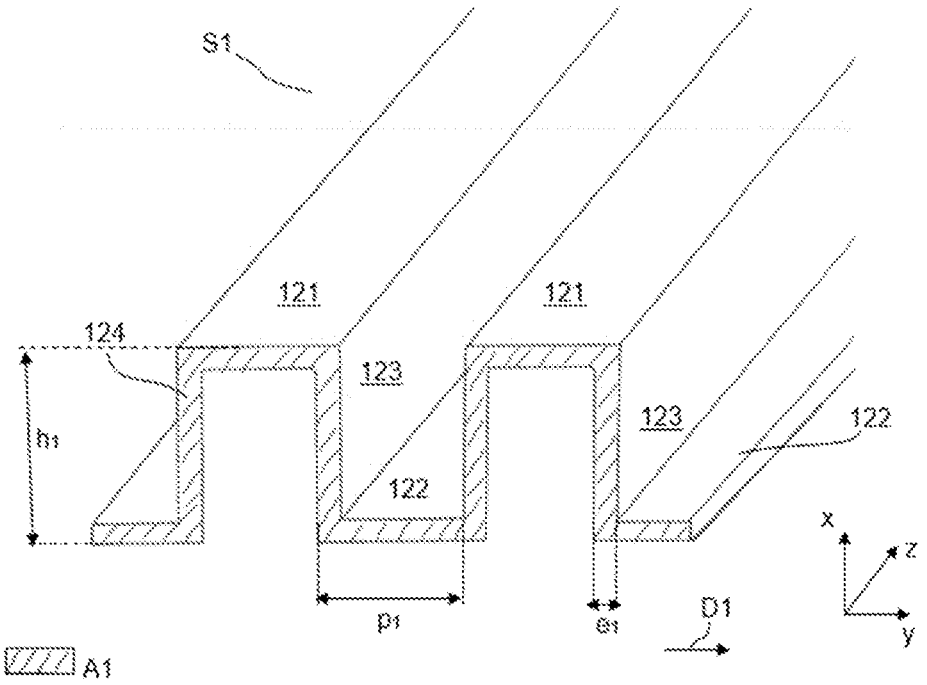
FIG. 5 shows a portion of a heat exchange structure of an exchanger according to another embodiment of the invention.

With reference to FIG. 4 and FIG. 5, a structure S according to the invention comprises a plurality of series of fluid guiding walls 121, 122, 123 (only one series is shown in FIG. 5), with said walls being arranged parallel to the longitudinal direction z and having first leading edges 124 disposed substantially orthogonal to the longitudinal direction z and fully or partly facing the two-phase cooling stream when it flows through the passage 10. The series of walls follow one another in the longitudinal direction z.

FIG. 4 shows walls 121, 122, 123 with a thickness e1, measured in a plane orthogonal to the longitudinal direction z and following a direction orthogonal to the walls. The structure has a height h, measured in a stacking direction x, which is orthogonal to the longitudinal direction z and orthogonal to the plates 2.

According to the invention, the cross-sectional area is measured orthogonally to the longitudinal direction z and per meter of exchanger length. Determining the cross-sectional area A per unit of exchanger length allows a progressive variation of said cross-section to be qualified along the passage 10 and/or allows any differences in length to be overcome when different portions S1, S2, . . . of structures (see below) are considered. For example, in FIG. 5, the cross-sectional area A1 of the leading edges of the walls 121, 122, 123 corresponds to the shaded area.

The arrangement of an exchange structure, for which the cross-sectional area of leading edges decreases toward the first end 2*a*, allows any disparities in pressure drops experienced by the cooling stream 203 along the passage 10 to be compensated.

Thus, at the second end 2*b*, where the amount of gas present in the stream is still relatively low, a larger leading edge area per unit length allows the pressure drops and the flow rate to be increased, promoting the ascent of the stream 203. As it flows in the longitudinal z direction, reducing the leading edge area allows the pressure drops experienced by the cooling stream 203 to be reduced.

The exchanger according to the invention allows the pressure drops to be adjusted over the length of the passage and allows a reasonable level of pressure drops to be maintained at the first end 2*a*. The energy performance capabilities of the industrial installation integrating the exchanger according to the invention are improved.

This also allows high enough fluid flow rates to be provided over the entire length of the passage, in particular at the second end 2*b* where entraining the liquid phase is critical. This results in a more uniform distribution of the two-phase cooling stream and an improvement in the performance capabilities of the exchanger. The exchanger thus can be designed with reduced safety margins compared to the margins that should be provided in the absence of structures according to the invention.

In addition, the exchanger can operate in steps called reduced steps, i.e. a lower flow rate, whether in a transient operating mode or in a steady state mode.

According to an embodiment that is schematically shown in FIG. 2, the exchange structure S has a cross-sectional area A of leading edges that decreases progressively, in a steady or unsteady manner, in the direction z. The structure S can be formed as one piece, i.e. from the same plate, or even from different separate parts juxtaposed in the direction z.

Figure 3:
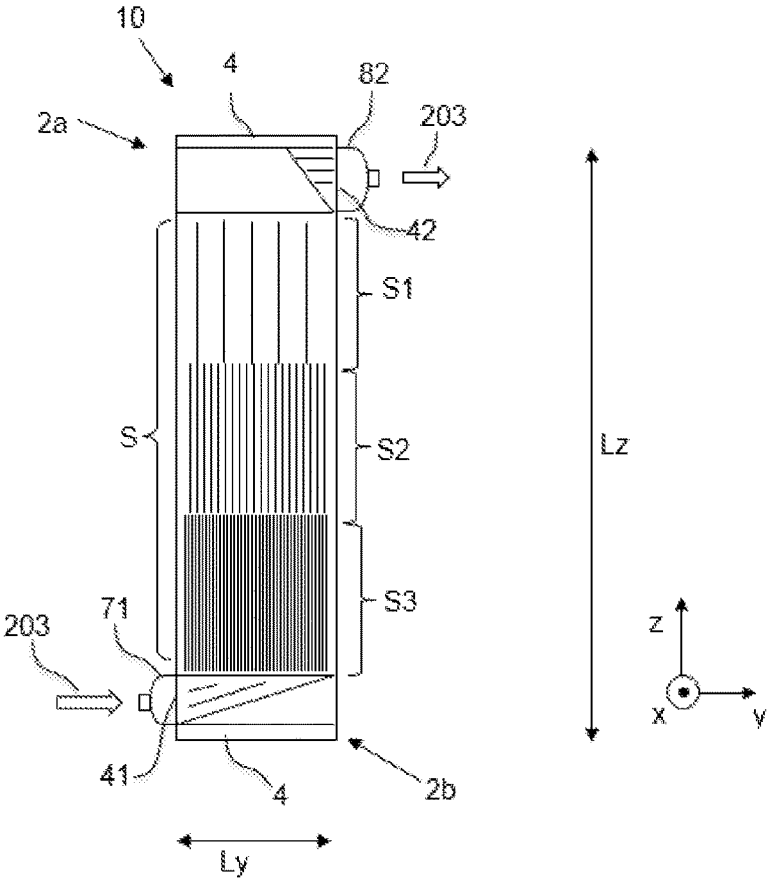
FIG. 3 is a schematic section view, in a plane parallel to the plates of the exchanger, of an exchanger passage configured for the flow of the two-phase cooling stream according to another embodiment of the invention.

According to another embodiment that is schematically shown in FIG. 3, the heat exchange structure S is divided, in the longitudinal direction z, into a plurality of portions S1, S2, . . . each having a cross-sectional area A1, A2, . . . of leading edges with a predetermined value, with said predetermined surface area values decreasing in the longitudinal direction z.

More specifically, said portions each have a constant leading edge surface area, with a reduction of said surface area being obtained by a variation from one portion to another.

FIG. 3 schematically shows a structure S with three portions S1, S2, S3, with it being understood that the structure S comprises at least two portions and can comprise more portions. The description provided hereafter for two portions can be applied to more portions.

Preferably, said portions S1, S2, . . . form separate physical entities, formed from separate strips. For example, the portions S1, S2 are separate wave mats. Advantageously, the structural portions are brazed together in the passage 10. One and/or other of said portions S1, S2 also can be formed by a plurality of separate sub-portions, preferably in the form of wave mats, brazed together in said passage 10.

Preferably, a portion S2 arranged upstream of another portion S1 in the longitudinal direction z, preferably consecutively, has a cross-sectional area A2 of leading edges that is increased by a multiplying factor of at least 1.3, preferably ranging between 1.5 and 5 relative to the cross-sectional area A1 of leading edges of the other portion S1.

Such a multiplying coefficient allows effective balancing of the pressure drops experienced by the two-phase cooling stream, in particular when said stream flows through the other portion S1 with a liquid/gas volume ratio that is lower, by at least 2%, preferably lower by 2 to 20%, than the liquid/gas volume ratio of the stream flowing in the portion S2, which is closer to the second end 2*b*. In this case, this involves average liquid/gas volume ratios over the lengths of each considered portion.

It should be noted that, preferably, the two-phase cooling stream introduced into the heat exchanger E2 has a liquid/gas volume ratio ranging between 10 and 100%, preferably between 10 and 60%, with said ratio being defined as the ratio between the volume flow rate of the liquid phase and the volume flow rate of the gaseous phase of the two-phase cooling stream.

Advantageously, each series of fluid guiding walls 121, 122, 123, 221, 222, 223 forms a corrugation comprising a plurality of fins 123, 223 following one another in the lateral direction y, with wave peaks 121, 221 and wave troughs 122, 222 alternately connecting said fins 123, 223. The fins preferably follow one another at regular intervals. Said corrugations have pitches p1, p2 defined as the distances between two successive fins of the same corrugation measured in the lateral direction y. To express the pitches p1 and p2 of the corrugations, the relations p1=25.4/n1 and p2=25.4/n2 can be used, where n1 and n2 respectively represent the number of fins 123, 223 per inch, with 1 inch being equal to 25.4 millimeters, of the corrugations, measured in the lateral direction y.

Preferably, the first and second fluid guiding walls extend parallel to the longitudinal direction z. They may also be arranged parallel or orthogonally to the plates 2.

Preferably, said corrugations have increasing pitches in the longitudinal direction z. In other words, the corrugations have a decreasing fin density in the longitudinal direction z.

Alternatively or additionally, said corrugations have wall thicknesses that decrease in the longitudinal direction z.

Increasing the thickness or reducing the pitch of the fins allows the cross-sectional area of leading edges perceived by the two-phase cooling stream to be increased toward the second end of the exchanger, which tends to increase any pressure drops, and therefore the flow rate in this zone.

For example, if a structure S is considered that comprises a first and a second portion S1, S2, with the first portion S1 being arranged downstream of the second portion S2, i.e. further from the second end 2*b*, the walls of the second portion 221, 222, 223 have a second thickness e2 that is greater than the first thickness e1 of the walls 121, 122, 123 of the first portion S1. The term "downstream" is used by considering the direction of flow of the two-phase stream 203 in the portions S1, S2, . . . .

The first portion S1 can have a first corrugation pitch p1 that is greater than the second corrugation pitch p2 of the second portion S2.

As corrugations for the series of walls of the heat exchange structures S, the various types of waves can be used that are normally implemented in exchangers of the brazed plate and fin type. The waves can be selected from among the known types of wave, such as straight waves, serrated (partially offset) waves or herringbone waves. These waves may be perforated or not perforated.

FIG. 5 shows an embodiment in which a series of fluid guiding walls 121, 122, 123, which can form a portion S1 of the structure, form a corrugation of the straight wave type. This series of walls has a cross-sectional area A1 of leading edges 124.

Figure 6:
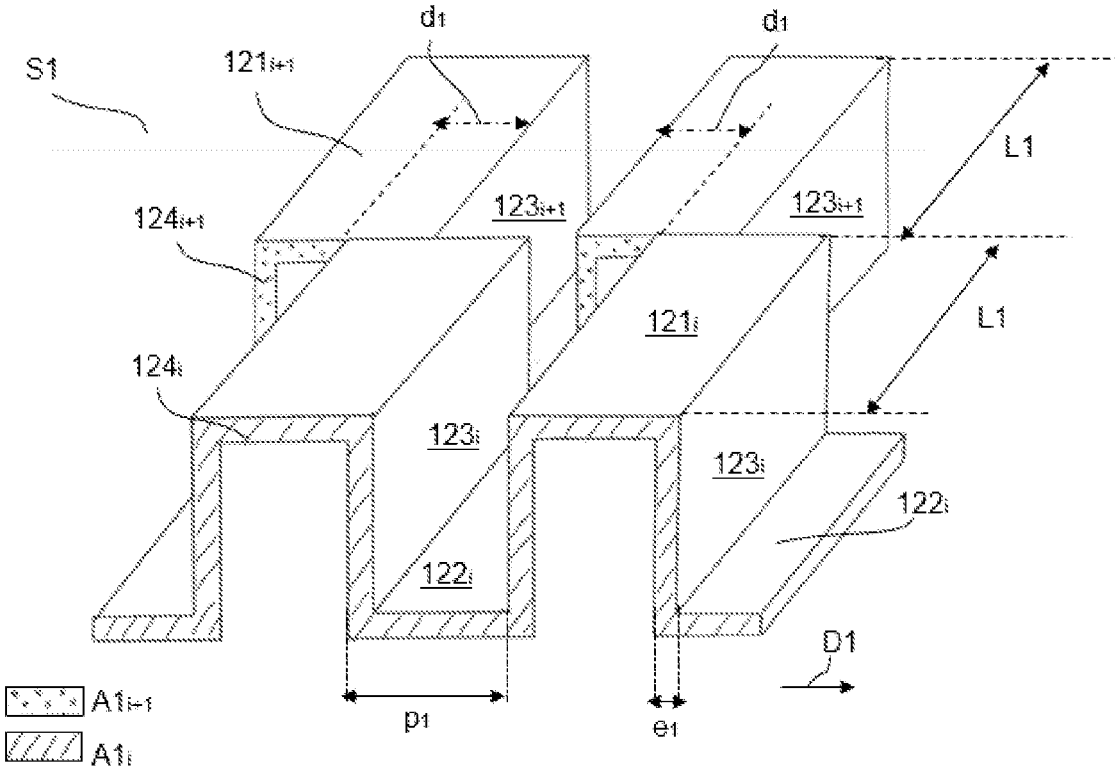
FIG. 6 shows a portion of a heat exchange structure of an exchanger according to another embodiment of the invention.
Figure 7:
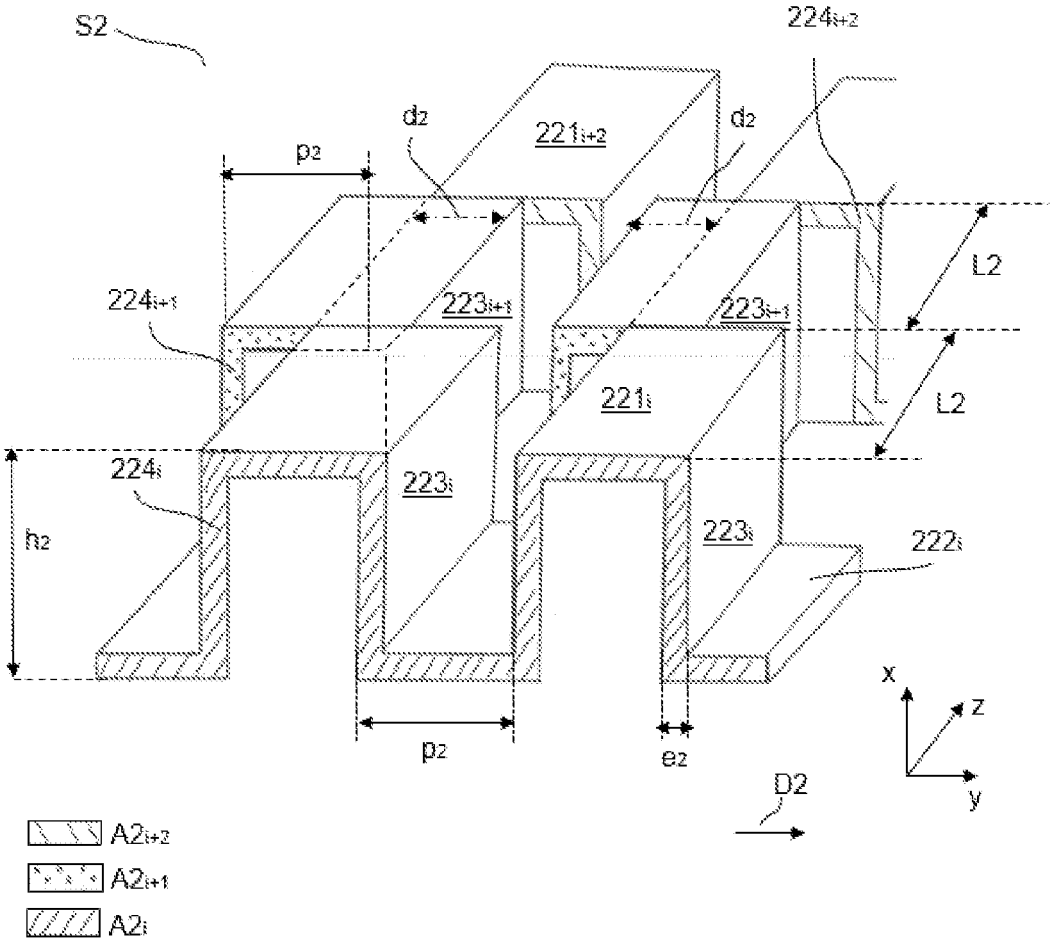
FIG. 7 shows a heat exchange structure of an exchanger according to another embodiment of the invention.

FIG. 6 and FIG. 7 show embodiments in which a plurality of series of fluid guiding walls, which can form a plurality of structure portions S1, S2, form partially offset waves.

As can be seen in FIG. 7, the portion S2 comprises a plurality of series of fluid guiding walls 221*i*, 222*i*, 223*i*, 221*i*+1, 222*i*+1, 223*i*+1, 221*i*+2, 222*i*+2, 223*i*+2. The series follow one another in the longitudinal direction z and each form a corrugation with a corrugation direction parallel to the lateral direction y. Each corrugation is offset by a predetermined distance d2, in the lateral direction y, relative to an adjacent corrugation. The corrugations have a length, called serration length L2, measured in the longitudinal direction z.

In the case of a partially offset wave, the cross-sectional area A2 of the leading edges of the portion S2 corresponds to the sum of the cross-sectional areas A2*i*, A2*i*+1, A2*i*+2, measured orthogonally to the longitudinal direction z and expressed per meter of exchanger length, of the leading edges 224*i*, 224*i*+1, 224*i*+2 of each series of guiding walls.

The above description is applicable to the portion S1 shown in FIG. 6.

Within the scope of the invention, the variation of the cross-sectional area of leading edges of the exchange structure S in the longitudinal direction z can be obtained by varying at least one characteristic dimension, such as the thickness, the wave pitch, the serration length, etc., within the structure.

In particular, this variation can occur between portions of structures of the same type. For example, the heat exchange structure S can comprise a plurality of partially offset wave portions, with the serration length increasing toward the first end.

FIG. 6 and FIG. 7 show such an embodiment in which the heat exchange structure S comprises at least two portions S1, S2 in the form of partially offset waves. Advantageously, the portion S2 arranged upstream of the other portion S1 has a serration length L2 that is shorter than the serration length L1 of the other portion S1. This allows more leading edges to be arranged per meter of exchanger length at the second end 2*b*, and therefore allows the cross-sectional area of leading edges and the resulting pressure drops on the fluid flowing opposite these leading edges to be increased.

Preferably, a serration length L1 for the other portion S1 will be selected that is greater than the serration length L2 of the portion S2 by a factor ranging between 1.7 and 7, with this being the case for a portion S2 arranged upstream of another portion S1, preferably adjacent thereto. Preferably, the serration lengths can range between 1 and 15 mm, preferably between 3 and 13 mm.

Preferably, the offset distances range between 1 and 20 mm, preferably between 3 and 15 mm.

Preferably, the characteristic dimensions of the waves other than the serration lengths, such as offset distances, thickness, wave pitch, etc., are identical within the exchange structure S.

It is also possible to implement a variation of the type of wave within the structure S in order to balance the pressure drops experienced by the refrigerants on these two portions. For example, arranging one or more portions S2, S3 with a partial offset at the second end and arranging one or more portions S1, S2 as a straight wave at the first end. A straight wave actually introduces fewer leading edges into the passage and thus less pressure drops.

With reference to FIG. 4, FIG. 5, FIG. 6 or FIG. 7, it should be noted that, for a given heat exchange structure S1 or S2 comprising fluid guiding walls of thickness e1 or e2 forming at least one first corrugation of pitch p1 or p2, of height h1 or h2, the cross-sectional areas A1, A2 per meter of exchanger length can be defined using the following relations:

$$A1 = \frac{(h1 \times e1) + [(p1 - e1) \times e1]}{p1} \times Ly \times K1 \quad \text{Math 1}$$

$$A2 = \frac{(h2 \times e2) + [(p2 - e2) \times e2]}{p2} \times Ly \times K2 \quad \text{Math 2}$$

where Ly is the width of the passage 10 in which the two-phase cooling stream flows; and K1 or K2 equal 1 in the case whereby the portion S1 or S2 is a straight wave, i.e. the fluid guiding walls of which form a single corrugation, without any offset; or K1=1000/L1 or K2=1000/L2 in the case whereby the portion S1 or S2 is a partially offset wave with a plurality of offset corrugations, with L1 or L2 being the serration lengths expressed in millimeters for S1 or S2.

For example, for a partially offset wave S2, called "⅛" serrated" (1"=1 inch=25.4 mm), L2=25.4/8=3.18 mm. For a partially offset wave S1, called "⅕" serrated" (1"=1 inch=25.4 mm), L1=25.4/5=5.08 mm.

Advantageously, the method for liquefying a hydrocarbon stream according to the invention can implement one or more additional refrigeration cycles carried out upstream of the main refrigeration cycle described above, so as to pre-cool the hydrocarbon stream.

Figure 8:
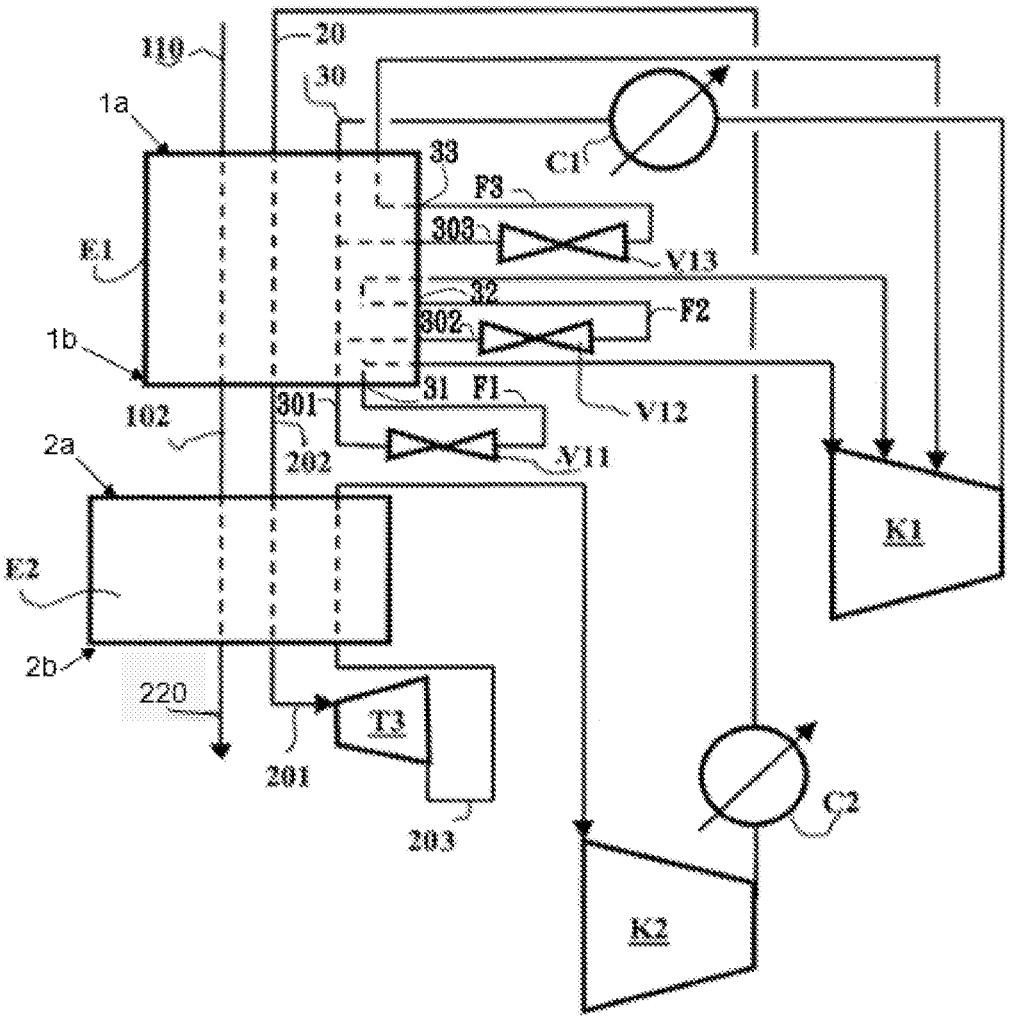
FIG. 8 schematically shows a method for liquefying a hydrocarbon stream according to another embodiment of the invention.

FIG. 8 schematically shows a method for liquefying a hydrocarbon stream, such as natural gas, comprising an additional refrigeration cycle, in which the natural gas is cooled to its dew point using at least two different expansion levels in order to increase the efficiency of the cycle. This additional refrigeration cycle is implemented by means of an additional cooling stream in an additional heat exchanger E1, called pre-cooling exchanger, arranged upstream of the heat exchanger E2, which then forms the liquefaction exchanger.

In this embodiment, the supply stream 110 arrives, for example, at a pressure ranging between 4 MPa and 7 MPa and at a temperature ranging between 30° C. and 60° C. With the supply stream 110 comprising a mixture of hydrocarbons, such as natural gas, the cooling stream 202 and the additional cooling stream 30 enter the exchanger E1 in order to circulate therein in parallel directions and co-currently in the downward direction.

A cooled, or even at least partially liquefied, hydrocarbon stream 102 exits the pre-cooling exchanger E1. Preferably, the hydrocarbon stream 102 exits in the gaseous or partially liquefied state, for example, at a temperature ranging between −35° C. and −70° C. Preferably, the cooling stream 202 exits the exchanger E1 completely condensed, for example, at a temperature ranging between −35° C. and −70° C. The stream 102 is then introduced into the exchanger E2.

As can be seen in FIG. 8, the vaporized cooling stream exits the exchanger E2 in order to be compressed by the compressor K2 and then cooled in the indirect heat exchanger C2 by exchanging heat with an external cooling fluid, for example, water or air. The second cooling stream originating from the exchanger C2 is sent into the exchanger E1 via the pipe 20.

The additional cooling stream can be formed by a mixture of hydrocarbons, such as a mixture of ethane and propane, but also can contain methane, butane and/or pentane. The mole fraction proportions (%) of the components of the first cooling mixture can be:

Ethane: 30% to 70%;

Propane: 30% to 70%;

Butane: 0% to 20%;

In the method described in FIG. 8, the cooling stream 202 is not split into separate fractions, but, in order to optimize the approach in the exchanger E2, the cooling stream also can be separated into two or three fractions, with each fraction being expanded to a different pressure level and then sent to different stages of the compressor K2.

In the additional exchanger E1, which is also of the plate and fin type, at least two partial streams originating from the additional cooling stream are withdrawn from the exchanger at two separate outlet points and then expanded to different pressure levels, thus forming the at least one first and one second separate refrigerant fluid F1 and F2 reintroduced into the exchangers via separate inlets 31, 32 selectively supplying additional refrigerant passages in order to be vaporized therein with the supply stream, the cooling stream and part of the additional cooling stream.

In the embodiment according to FIG. 8, three fractions 301, 302, 303, also called partial flows or streams, of the additional cooling stream 30 in the liquid phase are successively withdrawn. The fractions are expanded through the expansion components, such as valves, turbines or combinations of valves and turbines, V11, V12 and V13 to three different pressure levels, forming a refrigerant F1, a second refrigerant F2 and a third refrigerant F3. These three refrigerants F1, F2, F3 are reintroduced into the additional exchanger E1 and then vaporized.

The three vaporized refrigerants F1, F2, F3 are sent to different stages of the compressor K1, compressed, then condensed in the condenser C1 by exchanging heat with an external cooling fluid, for example, water or air. The first cooling stream originating from the condenser C1 is sent into the additional exchanger E1 via the pipe 30. The pressure of the first cooling stream at the outlet of the compressor K1 can range between 2 MPa and 6 MPa. The temperature of the additional cooling stream at the outlet of the condenser C1 can range between 10° C. and 45° C.

Preferably, the refrigerants F1, F2, F3 flow from one end 1*b* of the additional exchanger E1 to another end 1*a* in the longitudinal direction z, in the upward direction. The end 1*b* corresponds to the cold end of the additional exchanger E1 where the refrigerant F1 is introduced at the lowest temperature of the temperatures of the additional exchanger E1.

Advantageously, the exchanger E1 comprises at least one of the passages for the flow of refrigerants of the pre-cooling cycle, in which at least one additional heat exchange structure is arranged with a cross-sectional area of leading edges that decreases in the direction z. Said additional heat exchange structure can comprise one or more of the previously described features.

The arrangement of exchange structures with different cross-sectional areas of leading edges allows the pressure drops experienced by the refrigerants along the refrigerant passages to be balanced, while maintaining a reasonable level of pressure drops at the other end 1*a* of the exchanger E1. The energy performance capabilities of the industrial installation integrating the exchanger E1 are further improved.

Of course, the invention is not limited to the particular examples described and illustrated in the present application. Other alternative forms or embodiments within the competence of a person skilled in the art may also be contemplated without departing from the scope of the invention. For example, other configurations for injecting and extracting fluids into and from the exchanger, other directions of flow of the fluids, other types of fluids, other types of heat exchange structures, etc. clearly can be contemplated, depending on the constraints stipulated by the method to be implemented.

The invention claimed is:

1. A method for liquefying a hydrocarbon stream using a heat exchanger comprising a plurality of plates parallel to each other and to a longitudinal direction that is substantially vertical, said exchanger having a length measured in the longitudinal direction, the plates being stacked with spacing so as to define between them at least one first series of passages for the flow of at least part of a two-phase cooling stream vaporizing by exchanging heat with at least the hydrocarbon stream, said method comprising:

a) introducing the hydrocarbon stream into the heat exchanger;

b) introducing a cooling stream into the heat exchanger via at least one first inlet thereby passing through the heat exchanger and exiting from a first outlet, said first inlets and first outlet being arranged so that the cooling stream flows through the exchanger in a downward along the longitudinal direction;

c) discharging the cooling stream via the first outlet of the exchanger;

d) expanding the cooling stream originating from step c) so as to produce a two-phase cooling stream;

e) reintroducing at least part of the two-phase cooling stream into the heat exchanger via at least one second inlet thereby passing through the heat exchanger and exiting from a second outlet, said second inlets and second outlet being arranged so that said at least part of the two-phase cooling stream flows through the passages of the first series in an upward direction oriented in the longitudinal direction;

f) vaporizing said at least part of the two-phase cooling stream in the passages of the first series by exchanging heat with at least the hydrocarbon stream, so as to obtain an at least partially liquefied hydrocarbon stream at the outlet of the exchanger, wherein at least one passage of the first series comprises a heat exchange structure comprising a plurality of series of fluid guiding walls, said series of fluid guiding walls following each other in the longitudinal direction and having leading edges, which extend orthogonally to the longitudinal direction so as to fully or partly face the two-phase cooling stream, said fluid guiding walls having leading edges which decrease in cross-sectional area as they traverse the heat exchange longitudinally from a bottom to a top vertically.

2. The method as claimed in claim 1, wherein, in step e), the liquid/gas volume ratio of said at least part of the two-phase cooling stream reintroduced into the heat exchange ranges between 10 and 100%, with said at least part of the two-phase cooling stream flowing in the passages of the first series having a liquid/gas volume ratio that decreases in the longitudinal direction.

3. The method as claimed in claim 1, wherein said series of fluid guiding walls each form a corrugation comprising a plurality of fins following each other in a lateral direction, which is orthogonal to the longitudinal direction and parallel to the plates, with wave peaks and wave troughs alternately connecting said fins.

4. The method as claimed in claim 1, wherein, in step a), the hydrocarbon stream is introduced into the heat exchanger in the gaseous or partially liquefied state at a temperature ranging between −80 and −35° C.

5. The method as claimed in claim 1, wherein, in step e), said at least part of the two-phase cooling stream is reintroduced into the heat exchanger at a first temperature ranging between −120 and −160° C. and exits the heat exchanger at a second temperature higher than the first temperature.

6. The method as claimed in claim 1, wherein, prior to step a), at least one additional refrigeration cycle is implemented comprising the following steps:

i) introducing a supply stream, comprising a mixture of hydrocarbons into an additional heat exchanger comprising a set of other plates parallel to each other and to the longitudinal direction and stacked with spacing so as to define between them at least one set of additional refrigerant passages;

ii) introducing an additional cooling stream into the additional heat exchanger;

iii) extracting, from the heat exchanger, at least two partial cooling streams originating from the additional cooling stream and expanding said partial cooling streams to different pressure levels in order to produce at least two two-phase refrigerants;

iv) reintroducing at least part of each refrigerant into respective additional refrigerant passages of the heat exchanger and at least partially vaporizing said at least part of each refrigerant by exchanging heat with at least the supply stream, so as to obtain a pre-cooled hydrocarbon stream at the outlet of the additional heat exchanger;

v) introducing the pre-cooled hydrocarbon stream into the heat exchanger.

7. The method as claimed in claim 6, wherein the refrigerants flow upwards in the longitudinal direction in the respective additional refrigerant passages of the heat exchanger.

8. The method as claimed in claim 6, wherein at least one additional refrigerant passage comprises at least one additional heat exchange structure comprising a plurality of additional series of fluid guiding walls, said series following each other in the longitudinal direction and having additional leading edges extending orthogonally to the longitudinal direction so as to fully or partly face the two-phase refrigerants, said additional heat exchange structure having a cross-sectional area of leading edges that decreases in the longitudinal direction.

* * * * *